US008047214B2

(12) United States Patent
Thorpe et al.

(10) Patent No.: US 8,047,214 B2
(45) Date of Patent: Nov. 1, 2011

(54) POWDER PUFF DISPENSER WITH FLOW-THROUGH GASKET

(75) Inventors: Timothy Thorpe, Santa Monica, CA (US); Luis Alviar, Salem, OR (US)

(73) Assignee: HCT Asia Ltd, Central (HK)

( * ) Notice: Subject to any disclaimer, the term of this patent is extended or adjusted under 35 U.S.C. 154(b) by 560 days.

(21) Appl. No.: 12/172,145

(22) Filed: Jul. 11, 2008

(65) Prior Publication Data

US 2008/0264440 A1 Oct. 30, 2008

(51) Int. Cl.
*A45D 33/02* (2006.01)

(52) U.S. Cl. ..... 132/299

(58) Field of Classification Search ..... 132/298, 132/299, 305–307, 293–294; 401/200, 202
See application file for complete search history.

(56) References Cited

U.S. PATENT DOCUMENTS

| | | | | |
|---|---|---|---|---|
| 1,365,246 | A | 1/1921 | Kendall | |
| 2,990,086 | A * | 6/1961 | Williams | 222/142.3 |
| 3,729,011 | A | 4/1973 | Gleicher | |
| 4,674,537 | A * | 6/1987 | Bergmann | 137/625.31 |
| 4,906,120 | A | 3/1990 | Sekiguchi et al. | |
| 6,142,695 | A | 11/2000 | Byun | |
| 6,363,948 | B2 | 4/2002 | Choi | |
| 6,418,939 | B1 | 7/2002 | Byun | |
| 6,793,431 | B1 | 9/2004 | Tsai | |
| 6,935,802 | B1 | 8/2005 | Byun | |
| 7,101,107 | B1 | 9/2006 | Byun | |
| 7,234,474 | B2 | 6/2007 | Byun | |
| 7,237,973 | B1 | 7/2007 | Lou | |
| D598,655 | S | 8/2009 | Thorpe et al. | |
| 2003/0024545 | A1 * | 2/2003 | Delage | 132/299 |
| 2004/0120753 | A1 * | 6/2004 | Gieux | 401/200 |
| 2004/0250833 | A1 | 12/2004 | Jang | |
| 2007/0098485 | A1 | 5/2007 | Byun | |
| 2007/0158372 | A1 | 7/2007 | Kurek et al. | |
| 2008/0264440 | A1 | 10/2008 | Thorpe | |

FOREIGN PATENT DOCUMENTS

| | | | |
|---|---|---|---|
| GB | 2404370 | A | 2/2005 |
| GB | 2446039 | A | 7/2008 |
| JP | 9056462 | A | 3/1997 |
| JP | 2004222853 | A | 8/2004 |
| WO | WO 2006101339 | A1 | 9/2006 |

OTHER PUBLICATIONS

European Search Report from the Intellectual Property Office, Patents Directorate, South Wales, for Application No. GB0817901.2, mailed on Feb. 12, 2009, 5 pgs.

(Continued)

*Primary Examiner* — Todd Manahan
*Assistant Examiner* — Brianne O'Neill
(74) *Attorney, Agent, or Firm* — Lee & Hayes, PLLC

(57) ABSTRACT

A dispenser includes a housing having a reservoir for containing a product. The dispenser includes a flow-through gasket with a concave shape top having a plurality of apertures. The dispenser provides a product delivery passageway through the flow-through gasket when the dispenser is in an open position. The dispenser prevents leakage by providing a seal with the flow-through gasket when the dispenser is in a closed position. In some examples, the flow-through gasket with the concave shape top may be made of a material having elastomeric properties.

20 Claims, 7 Drawing Sheets

OTHER PUBLICATIONS

European Search Report from the Intellectual Property Office, Patents Directorate, South Wales for Application No. GB0817902.0, mailed on Feb. 12, 2009, 8 pgs.

International Search Report from Application No. GB0900737.8, mailed on May 21, 2009, 7 pages.

CN 3203451, Registered Industrial Design Application (Tianjin Samsung Brushes Ltd.) Oct. 10, 2001.

CN 3401674, Registered Industial Design Application (Tianhin Samsung Brushes Ltd.), Nov. 3, 2004.

* cited by examiner

POWDER PUFF DISPENSER WITH FLOW-THROUGH GASKET

BACKGROUND

Devices exist for dispensing cosmetic, medicinal, food, household, or other type products. Such devices usually consist of an outer housing, a delivery mechanism for dispensing the different types of products, and an applicator. For example, in various industries, devices are employed for applying powder, gel, creams, or lotions. In the cosmetics and personal care industries, devices are used to apply lipstick, lip balm, skin creams, lotions, compact powder, loose powder, and other cosmetic products to portions of the face and body.

Typically, these devices have many drawbacks. For example, the product may not be dispensed at a controlled rate, allowing either too little or too much to come out of the device. Another problem is that an applicator on the device may allow product to continue to flow out of the device, once the desired amount of product has been dispensed. For example, the product may leak or spill out of the device, especially when travelling from one location to another for reapplication during the day, resulting in a wasted amount of product and a mess for the user. Accordingly, there remains a need in the art for improved devices.

SUMMARY

This summary is provided to introduce simplified concepts of dispensers with flow-through gaskets, which are further described below in the Detailed Description. This summary is not intended to identify essential features of the claimed subject matter, nor is it intended for use in determining the scope of the claimed subject matter.

This disclosure is directed to a dispenser with a flow-through gasket having a plurality of apertures and a concave shape top. This disclosure describes a dispenser which includes a housing with a reservoir for containing a powdered cosmetic product. The dispenser includes a flow-through gasket with a plurality of apertures and having a concave shape top. The dispenser has actuator being rotatable to selectively deliver the powdered cosmetic product through the plurality of apertures in the flow-through gasket and to store product in the concave shape top, at least temporarily. Furthermore, the dispenser with the flow-through gasket is capable of delivering product and preventing leakage of product.

The features, functions, and advantages that have been discussed above or will be discussed below can be achieved independently in various implementations, or may be combined in yet other implementations, further details of which can be seen with reference to the following description and drawings.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

One implementation of this disclosure is directed towards dispensers with flow-through gaskets that are able to dispense product and to prevent leakage of the product. For example, a cosmetic dispenser includes a housing having a reservoir for containing a powdered cosmetic product. The dispenser includes a flow-through gasket with a plurality of apertures and a concave shape top. Furthermore, the dispenser includes an actuator being rotatable to selectively deliver the powdered cosmetic product through the plurality of apertures in the flow-through gasket. The dispenser includes an applicator coupled to the actuator for applying the powdered cosmetic product, such that the product delivery passageway terminates in the applicator.

Another implementation includes a product dispenser with a flow-through gasket having a plurality of apertures. An outer dial coupled to the flow-through gasket is rotatable between an open position defining a delivery passageway for a product and a closed position for preventing product leakage. The outer dial in the open position by rotation causes the plurality of apertures in the flow-through gasket to align with a plurality of apertures in an inner dial. Furthermore, the outer dial in the closed position by rotation causes the plurality of apertures in the flow-through gasket to align with a plurality of raised sections in the inner dial to prevent leakage of the product.

In yet another implementation, the flow-through gasket with a plurality of apertures may include a concave shape top and may be made of a material having elastomeric properties. The flow-through gasket having a concave shape top may also store product.

By way of example and not limitation, dispensers with flow-through gaskets described herein may be applied in many contexts and environments. For example, dispensers with flow-through gaskets may be implemented for medicinal products, cosmetics and personal care industries, powdered cosmetic products, mineral products, food products, spices, carpet deodorizers, baking soda, and the like. For example, in various industries, devices with flow-through gaskets may be employed for applying powdered, gel, creams, or lotions products. In the cosmetics and personal care industries, devices with flow-through gaskets may be used to apply lipstick, lip balm, skin creams, lotions, powdered, loose powder, and other cosmetic products to portions of the face and body.

An Illustrative Sponge Dispenser with Flow-Through Gasket—Concave Top

Figure 1:
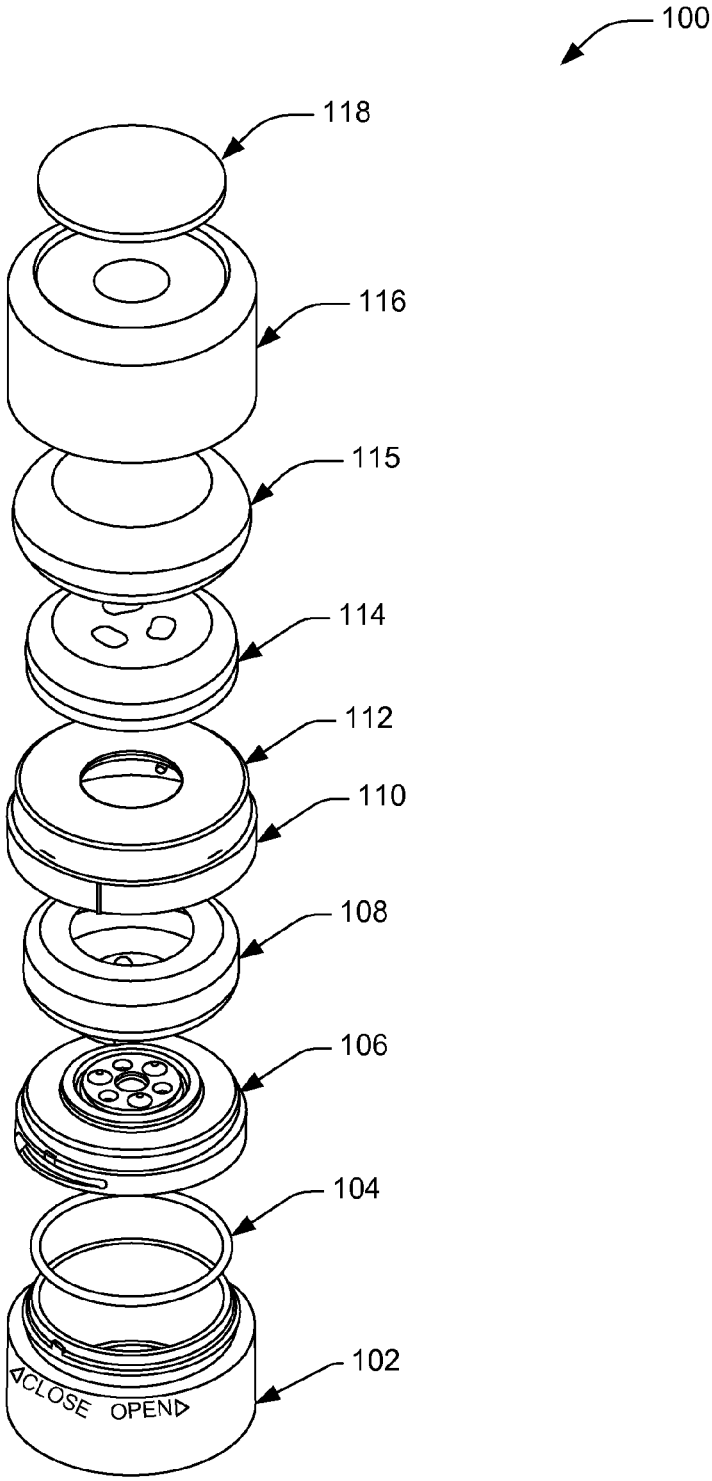
FIG. 1 is an exploded view of an illustrative dispenser with a flow-through gasket having a concave shape top according to one implementation.

FIG. 1 is an exploded view of an illustrative dispenser with a flow-through gasket having a concave shape top 100 according to one implementation. In this implementation, the dispenser 100 may rotate to an open position when an actuator causes a plurality of apertures in the flow-through gasket having a concave top to be alignable with a plurality of apertures in an inner dial. Furthermore, the dispenser 100 may rotate to a closed position when the actuator causes a plurality of apertures in the flow-through gasket having the concave top to be alignable with a plurality of raised sections in the inner dial. For ease of convenience, the term "flow-through gasket having a concave top" may be used interchangeably with a shortened version of "flow-through gasket".

FIG. 1 represents the illustrative dispenser 100 having a housing 102 with a reservoir. The housing 102 has a ridge around the neck portion. The dispenser 100 also has an o-ring seal 104 that is coupled to an inner dial 106. In some instances, the housing 102 may be made of clear, substantially opaque, or translucent materials. The inner dial 106 may be secured to the housing 102, by, for example, a press-fit, a snap-fit, adhesive, and/or engagement by one or more engagement features. In the illustrated implementation, the housing 102 may include ribs to couple to the inner dial 106 along with the o-ring seal 104 to provide a secure fit.

The o-ring seal 104 is illustrated as being generally ring or circular-shaped. However, the o-ring seal 104 may be configured in virtually any desired shaped, such as oval, elliptical, spherical, curvilinear, trapezoidal, or the like. The o-ring seal 104 helps hold the inner dial 106 to the housing 102 to form a seal. The o-ring seal 104 may be made of materials by, for example, nitrile rubber, Buna-N, synthetic rubber copolymer of acrylonitrile and butadiene, thermoplastic elastomer (TPE), silicon, and the like.

The inner dial 106 includes a center-raised section surrounded by a plurality of raised sections alternating with a plurality of apertures. The plurality of apertures in the inner dial 106 may have shapes that includes but are not limited to, substantially circular-shaped, substantially square-shaped, or substantially oval-shaped. The number of apertures may range from at least about one to at most about five apertures.

The plurality of apertures in the inner dial 106 are alignable with a plurality of apertures in a flow-through gasket having a concave shape top 108 to cause the flow-through gasket to be in an open position. This open position allows for product delivery.

The size of the apertures in the inner dial 106 is of a sufficient size and of an adequate opening to allow for product delivery without being plugged. For example, the size of the apertures in the inner dial 106 may range from at least about 1 mm to at most about 6 mm. In one implementation, each aperture is at least about 2 mm in size.

The plurality of raised sections in the inner dial 106 are alignable with the plurality of apertures in the flow-through gasket 108 to cause the flow-through gasket to be in a closed position. This closed position prevents movement of the product along a delivery passageway. Furthermore, the flow-through gasket 108 allows a controlled rate of product to be dispensed at one time without loose powder being distributed all over the user.

The number and the size of apertures for the number and size of raised sections in the inner dial 106 should match the number of apertures in a flow-through gasket having a concave shape top 108. A more detailed discussion of the flow-through gasket 108 follows in FIGS. 5*a*, 5*b*, and 5*c*.

The dispenser 100 also includes an actuator 110, which may include an aperture and at least one or more ridges 112 around the external circumference of the actuator 110. The ridge 112 with the aperture provides a mechanism for the flow-through gasket 108 to attach to the actuator 110. This mechanism includes engagement with a base and a stem of the flow-through gasket 108 coupled to the ridge 112 on the actuator 110.

The actuator 110 may be secured to the inner dial 106 including but not limited to, a press-fit, a snap-fit, adhesive, and/or engagement by one or more engagement features. In the illustrated implementation, the actuator 110 may include ribs to couple to the inner dial 106 to allow for rotation of the actuator 110. Also, the actuator 110 may include at least one or more ridges around the external circumference for ease of convenience for the user to rotate the actuator 110.

The housing 102, the inner dial 106, and the actuator 110 may be constructed of materials including, but not limited to, wood, plastics, polymers, thermoplastics, composites thereof, or the like. In some implementations, the housing 102, the inner dial 106, and the actuator 110 may be made at least partially of a resin such as, for example, acrylonitrile butadiene styrene (ABS), styrene acrylonitrile (SAN), pentachlorothioanisole (PCTA), polypropylene (PP), polyethylene (PE), Polyurethane, combinations thereof, or the like.

FIG. 1 shows the dispenser 100 has a sponge applicator 114 and a sponge covering 115. The sponge applicator 114 includes a plurality of apertures for product delivery. The apertures in the sponge applicator 114 may range in number from at least about one to at most about fifteen apertures. The apertures in the sponge applicator 114 may range in size from at least about 1 mm to at most about 4 mm in diameter. The apertures in the sponge applicator 114 may be configured in virtually any desired shape, such as circular, disk-shaped, oval, elliptical, spherical, curvilinear, trapezoidal, or the like. The sponge cover 115 is made of a soft thermoplastic material that stretches over the sponge applicator 114. Both the sponge applicator 114 and the sponge cover 115 may be washed between applications.

The dispenser 100 may include a removable cap 116 or a cover that is sized and shaped to fit over the top of the sponge applicator 114. In an implementation, the removable cap 116 may snap onto the housing 102. In another implementation, the removable cap 116 may include threads to screw onto the housing 102 that mates with it. In other implementations, the dispenser 100 may include a clear plastic cover, a sliding pull up cover, and the like. In this illustration, the dispenser 100 includes the removable cap 116 that encapsulates the applicator 114 when the dispenser 100 is not in use. In another implementation, the dispenser 100 may not include a removable cap or cover.

The removable cap 116 may include a mirror 118 for convenience of the user to have the mirror 118 readily available when applying the product. The mirror 118 may range in thickness from at least about two mm to at most about eight mm. In various implementations, the mirror 118 may be coupled to the removable cap 116 by adhesive, press fit, snap fit, one or more ribs or barbs, or any other suitable fastening means. The mirror 118 may be located on the top, the side, or inside the removable cap 116. In another implementation, the dispenser 100 may not include a mirror.

While features of various illustrative implementations are described, in other implementations, housing 102, the o-ring seal 104, the inner dial 106, the actuator 110, the sponge applicator 114, the sponge cover 115, the removable cap 116, and the mirror 118 may be configured in any form suitable for the application of the product contained in dispenser 100. For example, the above items listed may be constructed in any other suitable shape and size and may have any suitable mass, surface finish, and/or surface treatment desired for a given application. In practice, the above items listed may be configured in virtually any desired shape, such as disk-shaped, oval, elliptical, spherical, curvilinear, trapezoidal, or the like.

Figure 2:
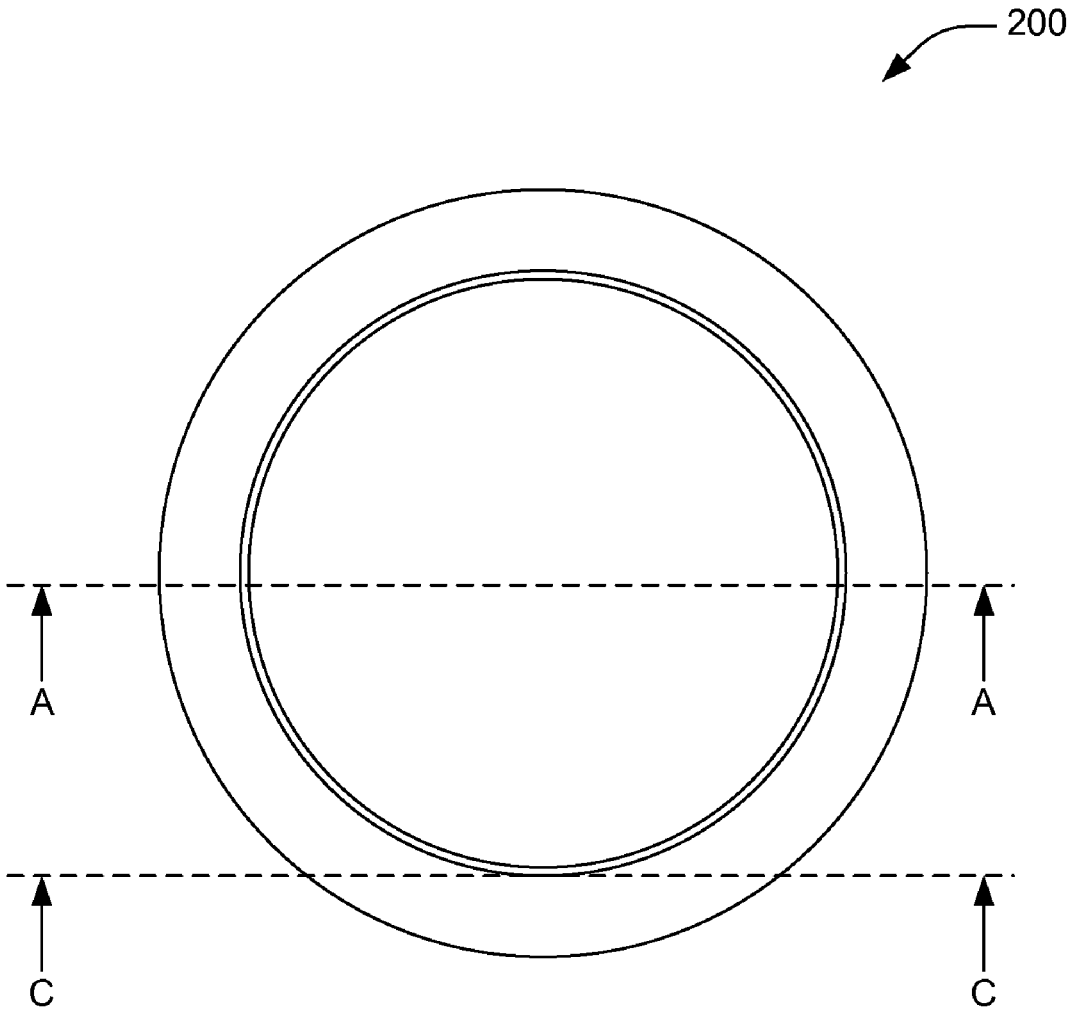
FIG. 2 is a top plan view, taken along line A-A and along line C-C of an illustrative dispenser cap with a flow-through gasket.
Figure 3:
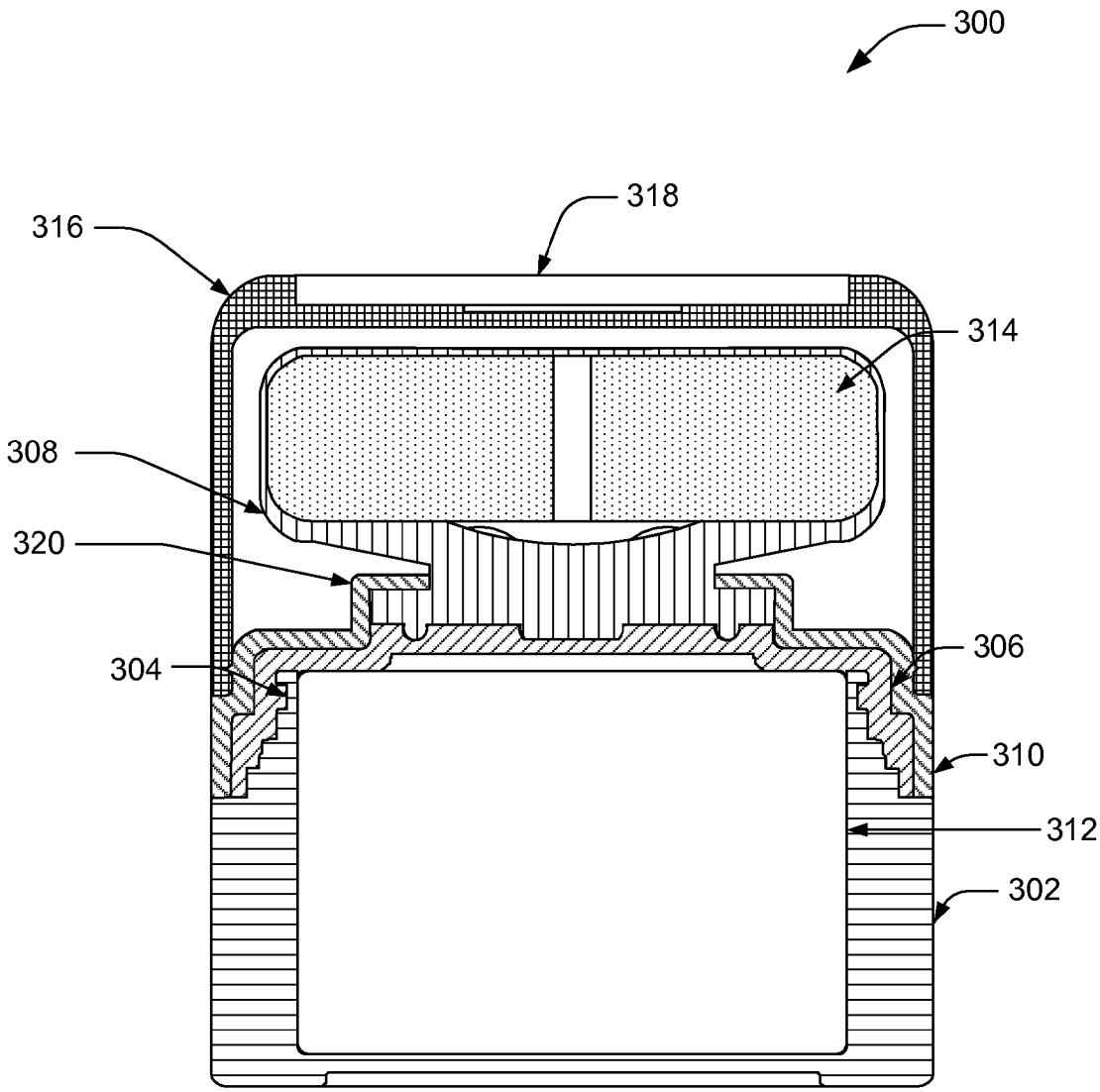
FIGS. 3-4 are cross-sectional views of dispensers according to other implementations.
Figure 4:
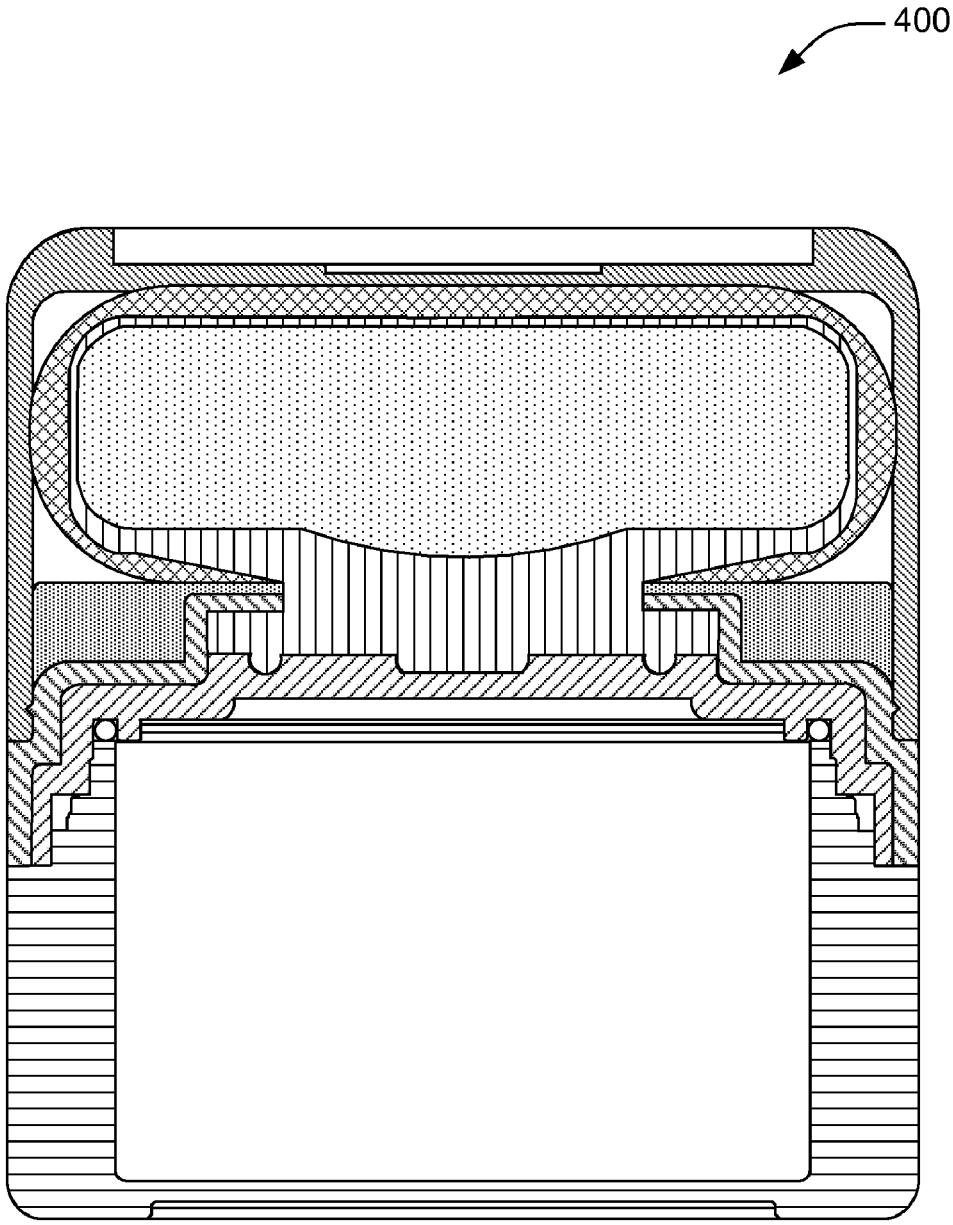

Illustrative Delivery Mechanism for Flow-through gasket having Concave Shape Top FIG. 2 is a top plan view, taken along line A-A and along line C-C of an illustrative dispenser removable cap with a flow-through gasket. FIGS. 3-4 are cross-sectional view of the dispenser according to implementations.

As shown in the cross sectional view for FIG. 3, the dispenser 300 includes a housing 302, an o-ring seal 304, an inner dial 306, a flow-through gasket having a concave top 308, and an actuator 310. The dispenser 300 also includes a reservoir 312, a sponge applicator 314, a removable cap 316, and a mirror 318 on the removable cap 316.

The flow-through gasket having the concave shape top 308 is shown in the center of the figure. In this illustration, a stem 320 of the flow-through gasket 308 is shown along with the plurality of apertures.

The following is a discussion of examples, without limitation, of delivery mechanisms for dispensing a product in the open position and of preventing product leakage in the closed position. The examples may be implemented using a rotation or reverse rotation operation, whereby a user may operate the dispenser 300 by moving the actuator 310 relative to the inner dial 306 in either a clockwise or a counterclockwise direction. However, in other implementations, any suitable delivery mechanism may be used.

Shown in FIG. 3 is how a product delivery passageway extends from the housing 302 and terminates in the sponge applicator 314. In one example, the actuator 310 serves as an operating mechanism to allow product delivery in the open position. The rotation of the actuator 310 to the open position causes a plurality of apertures of the flow-through gasket 308 to align with the plurality of apertures in the inner dial 306, such that the product is transported through this product delivery passageway. The product is dispensed from the reservoir 312 in the housing 302 through the inner dial 306 and through the flow-through gasket 308 to the applicator 314.

In one example, the actuator 310 serves as an operating mechanism to prevent product leakage by applying a downward pressure against the flow-through gasket 308 to create a seal. Furthermore, actuation by the user comprises a rotation mechanism that is helical by causing the actuator 310 to apply a downward pressure against the flow-through gasket 308 for the closed position. In this closed position, the actuator 310 provides a cam action seal by aligning small raised areas on the inner dial 306 to the plurality of apertures of the flow-through gasket 308. Thus, the closed position prevents product leakage by sealing the product delivery passageway.

FIG. 4 illustrates an implementation of a threaded housing and the inner dial. The various components for the dispenser 400 are shown in different types of hatch marks. In the example shown, the housing has threads to couple to the inner dial.

In implementations, the rotation mechanism may include a rotation at least about 10 degrees to at most about 359 degrees to the open position. In other implementations, the rotation mechanism may include a rotation at a minimum of at least about 5 degrees to at most about 350 degrees. Another example for delivery mechanism for dispensing the product may be a rotation of at least about 180 degrees, relative to a sufficient number of the plurality of apertures and a sufficient size of the plurality of apertures in the flow-through gasket.

Actuation may also occur by turning, depressing, sliding, tilting, or otherwise manipulating an outer cover, a knob on an outer cover, and/or by any other suitable dispensing mechanism. In an implementation, a knob on the outer cover allows product delivery. This may occur by sliding the knob to align the plurality of apertures in the flow-through gasket with a plurality of apertures in the outer cover. However, in other implementations, any suitable delivery mechanism may be used.

Illustrative Flow-Through Gasket Having Concave Shape Top

Figure 5A:
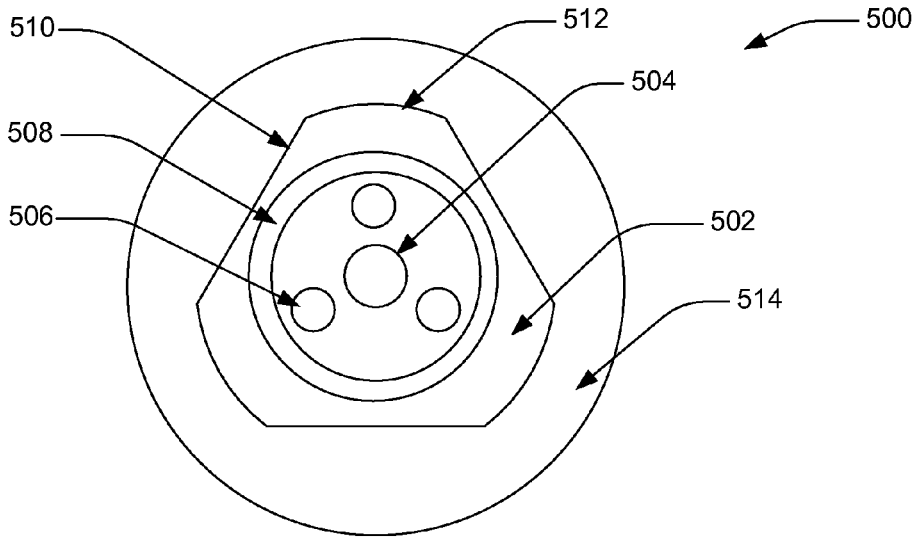
FIGS. 5*a*, 5*b*, and 5*c* are a bottom view, a side view, and a top plan view, respectively, of an illustrative flow-through gasket having a concave shape top.
Figure 5B:
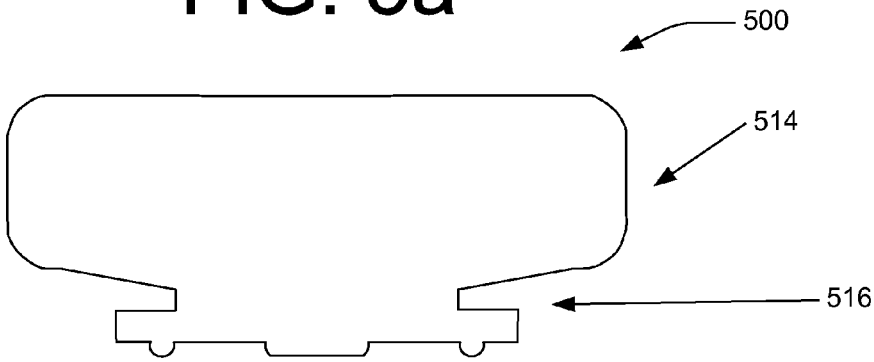
Figure 5C:
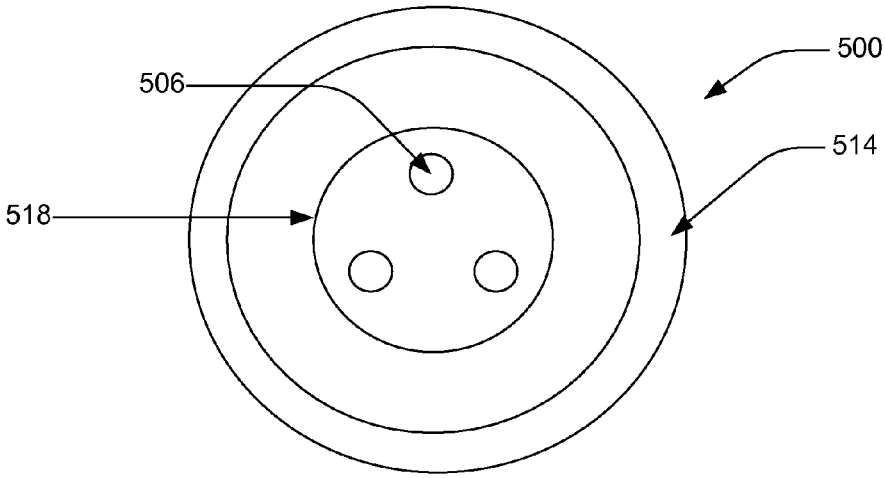

FIGS. 5*a*, 5*b*, and 5*c* illustrative a bottom view, a side view, and a top plan view, respectively, of an illustrative flow-through gasket having a concave shape top 500 in more detail.

The flow-through gasket having concave shape top 500 is made of a material capable of having both thermoplastic and elastomeric properties, including but not limited to a thermoplastic elastomer (TPE), a thermoplastic rubber, a thermoplastic polymer, an elastomer, and the like. In some implementations, the elastomeric material may comprise polyurethane, polyester copolymer, styrene copolymer, olefin, ethylene acrylic, chlorinated polyethylene, chlorosulfonated polyethylene, fluorocarbon, while in other implementations, the elastomeric material may comprise a relatively pliable or gel-like material such as butyl rubber, silicone, butadiene rubber, neoprene, nitrile, fluorosilicone, styrene-butadiene rubber (SBR), or the like.

FIG. 5*a* illustrates a bottom view of the flow-through gasket having concave shape top 500. As mentioned, the term "flow-through gasket having concave shape top" may be shortened to "flow-through gasket". FIG. 5*a* illustrates how the flow-through gasket 500 includes a substantially disk-shaped body 502 on a bottom side with a raised center section 504. The body 502 and the raised center section 504 may be in other configurations and shapes, including but not limited to substantially circular-shaped, substantially square-shaped, or substantially oval-shaped.

The flow-through gasket 500 includes a plurality of apertures 506 located on the substantially disk-shaped body 502. The plurality of apertures 506 aligns with the plurality of apertures of the inner dial 106 to deliver the product. The plurality of apertures 506 in the flow-through gasket 500 may have shapes that includes but are not limited to, substantially circular, substantially square-shaped, or substantially oval-shaped. In this illustration, the plurality of apertures 506 is substantially circular.

The size of the plurality of apertures 506 are of a sufficient size to allow for product delivery without being plugged. The size is of an adequate opening to allow the powdered particles to travel through the plurality of apertures 506. For example, the size of the plurality of apertures 506 in the flow-through gasket 500 may range from at least 1 mm to at most 6 mm. In one implementation, the plurality of apertures 506 is at least 2 mm diameter in size.

The number of the plurality of apertures 506 is of a sufficient number to allow for product delivery, but is dependent on the size of the aperture. In an implementation, the plurality of apertures 506 may include three apertures. In other implementations, the plurality of apertures may include but is not limited to, from at least one aperture to at most six apertures.

The arrangement of the plurality of apertures 506 may be of a triangular formation as shown in FIG. 5*a*, circular shaped with three apertures at least 2 mm diameter.

The substantially disk-shaped body 502 includes a circular ring 508 surrounding the plurality of apertures 506 and the raised center section 504, as shown on the bottom side of the substantially disk-shaped body 502.

The flow-through gasket 500 includes an outer perimeter including a plurality of flat sides 510 and a plurality of semicircular sides 512 alternating. The plurality of flat sides 510 and the plurality of semicircular sides 512 may apply to any sides of the substantially disk-shaped body 502. For example, the plurality of flat sides 510 may include, but is not limited to three sides arranged in a triangle type formation.

The plurality of semicircular sides 512 helps hold the flow-through gasket 500 secure against the actuator or the inner dial, depending on the configuration. The semicircular sides 512 may apply to any sides of the substantially disk-shaped body 502. In an implementation, there may be three semicircular sides 512 arranged in a triangle type formation. In another implementation, the substantially disk-shaped body 502 may include alternating flat sides 510 with alternating semicircular sides 512. The concave shape top 514 of the gasket can be seen from the bottom view.

FIG. 5*b* illustrates a side view of the flow-through gasket having concave shape top 500. The flow-through gasket 500 includes a stem 516 connecting to the substantially disk-shaped body 502. Furthermore, the concave shape top 514 and the stem 516 are formed integrally with the substantially disk-shaped body 502.

The depth and the width of the concave shape top are not limited to a particular size. In an implementation, the concave shape top in the flow-through gasket may include a depth of at least about 15 mm and a width of at least about 30 mm. In other implementations, the concave top in the flow-through gasket may include a depth of at least about 10 mm to at most about 20 mm and a width of at least about 20 mm to at most about 50 mm, and the concave top provides a temporary place for storing the product. However, in other implementations, any suitable depth and width may be used.

FIG. 5*c* illustrates a top plan view of the flow-through gasket 500. From this view, shown are how the plurality of apertures 506 terminates in a base 518 of the concave shape top 514.

While features of various illustrative implementations are described, in other implementations, the flow-through gasket 500 may be configured in any form suitable for the application of the product contained in the dispenser 100. For example, the flow-through gasket 100 may be constructed in any other suitable shape and size and may have any suitable number of apertures, size of apertures, shape of apertures desired for a given application. Fabrication of the dispenser and the flow-through gasket 500 may be accomplished through a separate manufacturing process, a co-molding process, or any other suitable production process. Fabrication of dispenser and flow-through gasket 500 may be accomplished through a separate manufacturing process, a co-molding process, or any other suitable production process.

Illustrative Exterior Views of the Dispenser with Flow-Through Gasket

Figure 6:
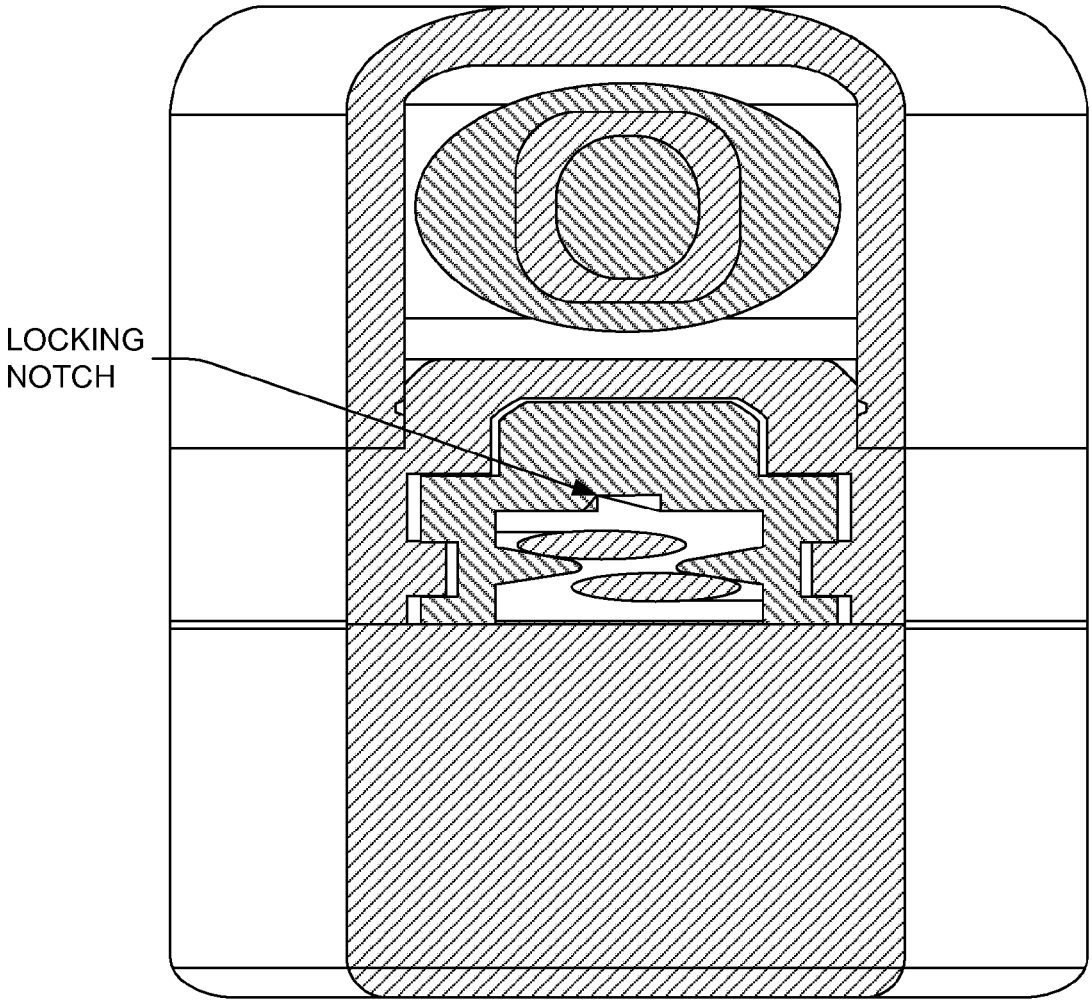
FIGS. 6 and 7 are exterior views of an illustrative dispenser with a flow-through gasket.
Figure 7:
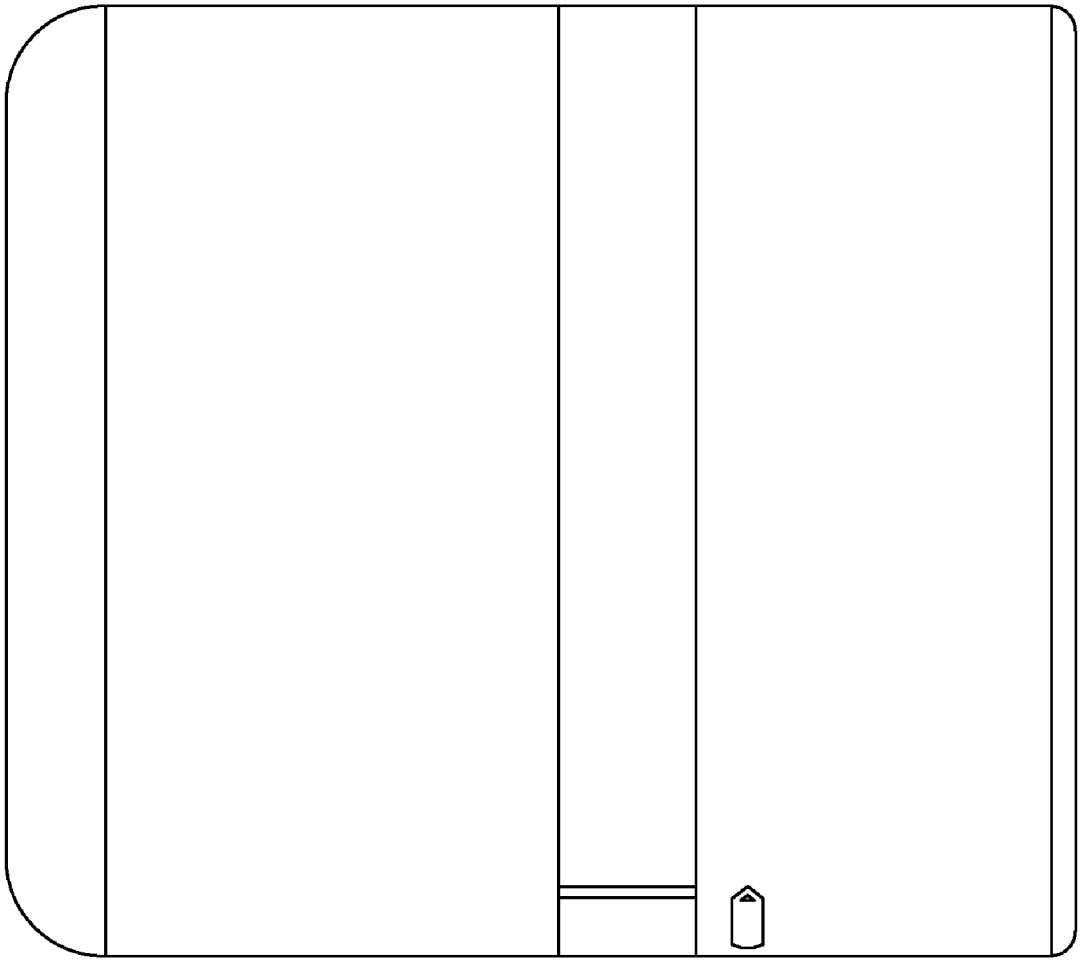

FIG. 6 illustrates an exterior view of an illustrative dispenser with a locking notch to hold the outer dial or actuator to the inner dial to keep the flow-through gasket in a sealed position. FIG. 7 illustrates an exterior view of an illustrative dispenser with a flow-through gasket. Any of these exterior views may apply to the dispensers with flow-through gaskets as discussed in this disclosure.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention.

What is claimed is:

1. A cosmetic dispenser comprising:

a housing having a reservoir for containing a powdered cosmetic product;

the housing including a flow-through gasket with a plurality of apertures and a concave shape top, the flow-through gasket having elastomeric properties;

an actuator coupled to the dispenser and the flow-through gasket, the actuator being selectively rotatable to an open position for the dispenser to deliver the powdered cosmetic product through the plurality of apertures in the flow-through gasket;

the actuator being selectively rotatable to a closed position for the dispenser to prevent leakage of the powdered cosmetic product by creating a seal with the plurality of apertures in the flow-through gasket; and an applicator coupled to the concave shape top of the flow-through gasket for applying the powdered cosmetic product.

2. The cosmetic dispenser of claim 1, wherein the flow-through gasket comprises a thermoplastic elastomer (TPE) material.

3. The cosmetic dispenser of claim 1, wherein the apertures in the flow-through gasket are substantially circular-shaped, substantially square-shaped, or substantially oval-shaped.

4. The cosmetic dispenser of claim 1, wherein the flow-through gasket comprises a substantially disk-shaped body with a raised center section on a bottom side.

5. The cosmetic dispenser of claim 4, wherein the flow-through gasket further comprises an elongated stem disposed between and formed integrally with the concave shape top and the substantially disk-shaped body.

6. The cosmetic dispenser of claim 4, wherein the flow-through gasket comprises:

the plurality of apertures being located on the bottom side of the substantially disk-shaped body;

a circular ring surrounding the plurality of apertures on the bottom side of the substantially disk-shaped body;

an outer perimeter comprising a plurality of flat sides and a plurality of semicircular sides, alternating on the substantially disk-shaped body, the plurality of semicircular sides to hold the flow-through gasket in place to the actuator when rotation occurs; and the plurality of apertures terminates in a base of the concave shape top.

7. The cosmetic dispenser of claim 1, wherein the concave shape top in the flow-through gasket comprises a depth of at least about 15 mm and a width of at least about 30 mm.

8. The cosmetic dispenser of claim 1, wherein the concave top in the flow-through gasket is substantially circular-shaped, substantially square-shaped, or substantially oval-shaped.

9. The cosmetic dispenser of claim 1, wherein the actuator being selectively rotatable to an open position comprises the plurality of apertures in the flow-through gasket being alignable with a plurality of apertures in an inner dial to define a delivery passageway for the powdered cosmetic product.

10. The cosmetic dispenser of claim 1, wherein the actuator being selectively rotatable to a closed position for the dispenser comprises the plurality of apertures in the flow-through gasket being alignable with a plurality of raised sections in an inner dial to define a seal to prevent leakage of the powdered cosmetic product.

11. The cosmetic dispenser of claim 1, wherein a rotation mechanism comprises a rotation of least about 10 degrees to at most about 359 degrees.

12. The cosmetic dispenser of claim 1, further comprising an o-ring seal located between the reservoir and an inner dial.

13. The cosmetic dispenser of claim 1, wherein the applicator comprises a sponge or a powder puff.

14. A dispenser comprising:

a housing having a reservoir for containing a product;

an actuator coupled to the housing, the actuator being selectively rotatable to an open position for the dispenser and the actuator being selectively rotatable to a closed position for the dispenser;

a flow-through gasket having a plurality of apertures and a concave shape top interposed between the housing and the actuator, the flow-through gasket being elastic and configured to create a seal upon the actuator being selectively rotatable to the closed position;

an applicator coupled to the concave shape top of the flow-through gasket for applying the product.

15. The dispenser of claim 14 wherein the flow-through gasket comprises a thermoplastic elastomer (TPE) material and the apertures in the flow-through gasket are substantially circular-shaped, substantially square-shaped, or substantially oval-shaped.

16. The dispenser of claim 14, wherein the flow-through gasket comprises:

a substantially disk-shaped body with a raised center section on a bottom side; and an elongated stem disposed between and formed integrally with the concave shape top and the disk-shaped body.

17. The dispenser of claim 16, wherein the flow-through gasket comprises:

the plurality of apertures being located on the bottom side of the substantially disk-shaped body; and a circular ring surrounding the plurality of apertures on the bottom side of the substantially disk-shaped body.

18. The dispenser of claim 16, wherein the flow-through gasket comprises:

an outer perimeter comprising a plurality of flat sides and a plurality of semicircular sides, alternating on the substantially disk-shaped body; and the plurality of apertures terminates in a base of the concave shape top.

19. The dispenser of claim 14, wherein the concave shape top in the flow-through gasket comprises a depth of at least about 15 mm and a width of at least about 30 mm.

20. The dispenser of claim 14, wherein the concave top in the flow-through gasket comprises a depth of at least about 10 mm to at most about 20 mm and a width of at least about 20 mm to at most about 50 mm, and the concave top provides a temporary place for storing the product.

* * * * *